US006543910B2

(12) United States Patent
Taniuchi et al.

(10) Patent No.: US 6,543,910 B2
(45) Date of Patent: Apr. 8, 2003

(54) VEHICLE LIGHT CAPABLE OF CHANGING LIGHT DISTRIBUTION PATTERN BETWEEN LOW-BEAM MODE AND HIGH-BEAM MODE BY MOVABLE SHADE AND REFLECTING SURFACE

(75) Inventors: Hitoshi Taniuchi, Tokyo (JP); Hiroshi Iwasaki, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 10/025,975

(22) Filed: Dec. 26, 2001

(65) Prior Publication Data

US 2002/0089853 A1 Jul. 11, 2002

(30) Foreign Application Priority Data

Dec. 25, 2000 (JP) ..... 2000-392979
Jun. 22, 2001 (JP) ..... 2001-190196

(51) Int. Cl.[7] ..... F21V 7/00

(52) U.S. Cl. ..... 362/297; 362/346; 362/351; 362/512; 362/319

(58) Field of Search ..... 362/297, 298, 362/302, 303, 512, 516, 517, 538, 539, 277, 351, 346, 319

(56) References Cited

U.S. PATENT DOCUMENTS 5,899,559 A 5/1999 Lachmayer et al. ..... 362/513
5,967,647 A * 10/1999 Eichler ..... 362/299
6,152,589 A * 11/2000 Kawaguchi et al. ..... 362/304
6,419,380 B2 * 7/2002 Oyama et al. ..... 362/297
6,454,448 B2 * 9/2002 Taniuchi et al. ..... 362/346

FOREIGN PATENT DOCUMENTS

EP 1 126 210 8/2001 ..... F21S/8/10

* cited by examiner

*Primary Examiner*—Thomas M. Sember
*Assistant Examiner*—John Amarantides
(74) *Attorney, Agent, or Firm*—Morgan, Lewis & Bockius LLP

(57) ABSTRACT

A vehicle light can include a single light source and be capable of switching between low-beam mode and high-beam mode by moving a movable portion. The vehicle light can also include a first reflecting surface, a projection lens, and a shutter selectively insertable in the luminous flux from the first reflecting surface to the projection lens. The vehicle light can further include a second reflecting surface having a first focus and a second focus, a third reflecting surface having a first focus and second focus, a fourth reflecting surface having a focus approximately on the second focus of the second reflecting surface, wherein when the third reflecting surface is located in its inserted position relative to luminous flux between the second reflecting surface and the fourth reflecting surface, the first focus of the third reflecting surface is substantially on the second focus of the second reflecting surface. The movable portion can include the shutter and the third reflecting surface.

20 Claims, 8 Drawing Sheets

CONVENTIONAL ART

VEHICLE LIGHT CAPABLE OF CHANGING LIGHT DISTRIBUTION PATTERN BETWEEN LOW-BEAM MODE AND HIGH-BEAM MODE BY MOVABLE SHADE AND REFLECTING SURFACE

This invention claims the benefit of Japanese Patent Applications No. 2000-392979, filed on Dec. 25, 2000, and No. 2001-190196, filed on Jun. 22, 2001, which are hereby incorporated by reference.

BACKGROUND OF THE INVENTION

1. Field of the Invention

The present invention relates to a vehicle light for use as an automobile headlight, and more particularly relates to a vehicle light including a single light source capable of switching modes of a light distribution pattern between a low-beam mode and a high-beam mode by a movable shutter. The structure of the present invention is directed to a case wherein it may be difficult to have two light sources such as when an incandescent lamp or a discharge lamp is adopted as a light source of the vehicle light.

2. Description of the Related Art

FIG. 18 illustrates a conventional vehicle light 90 comprising a single light source 91*a* capable of switching modes of a light distribution pattern. The vehicle light 90 comprises a high intensity discharge lamp 91 such as a metal halide lamp. A discharge arc 91*a* of the high intensity discharge lamp 91 is the light source for the conventional vehicle light 90. The vehicle light 90 also comprises a reflector 92 of an ellipse group reflecting surface such as a rotated elliptic surface 92 having a first focus f1 on the light source 91*a* and a second focus f2. The vehicle light 90 further comprises a shutter 93 located in the vicinity of the second focus f2 of the ellipse group reflecting surface 92, and a projection lens 94 of a convex lens having a focus in the vicinity of the second focus f2.

Light rays emitted from the light source 91*a* directly to the ellipse group reflecting surface 92 are reflected thereby and converge in the vicinity of the focus f2 of the projection lens 94. Light rays travel from the ellipse group reflecting surface 92 to its second focus f2 such that the light rays collectively form luminous flux having a shape of a substantial cone with an apex approximately on the second focus f2 in a cross-section along an optical axis X of the vehicle light 90. Light rays converged in the vicinity of the second focus f2 of the ellipse group reflecting surface 92 provide a focused image of light. Since the second focus f2 of the ellipse group reflecting surface 92 is also a focus of the projection lens 94, the projection lens 94 projects the focused image of light upside down with its left side to be the right side in a forward direction while enlarging the focused image, whereby the vehicle light 90 illuminates a predetermined front area on a road. The shutter 93 can be selectively inserted in, and removed from, the cone-like luminous flux. When the shutter 93 is inserted in the luminous flux, the shutter 93 cuts off an unnecessary portion of light to form a low-beam mode light distribution pattern of the vehicle light 90. The unnecessary portion of light is typically a portion which generally illuminates in an upper right forward direction of the vehicle after being projected by the projection lens 94, which can be glare light to a driver of a car driving on an on-coming lane (when driving forward on the left side of the road). The shutter 93 in its inserted position cuts off a lower area of a chord located in a lower half of a circular cross-sectional image of the cone-like luminous flux in the vicinity of the second focus f2, thereby the remaining luminous flux provides an approximate upper half of the circular cross-section. After passing through the projection lens 94, the image of an approximate upper half of the circular cross-section becomes an image of an approximate lower half of the circular cross-section. Accordingly, a low-beam mode light distribution pattern of the vehicle light 90 is obtained.

In the high-beam mode of the vehicle light 90, the shutter 93 is removed from the cone-like luminous flux. When the shutter 93 is removed from the cone-like luminous flux, an image of light rays converged in the vicinity of the second focus f2 of the ellipse group reflecting surface 92 is substantially circular and is consistent with the circular cross-section of the cone-like luminous flux. At this time, light rays traveling in an upward direction from the vehicle light 90 are included such that a far distant front area is illuminated.

The conventional vehicle light 90 has several drawbacks, some of which include the following problems. In the low-beam mode, a substantial half of the luminous flux from the ellipse group reflecting surface 92 is cut-off by the shutter 93. Accordingly, a light amount illuminated from the vehicle light 90 is reduced to approximately half of a light amount emitted from the light source 91*a*. In most times of operation, the vehicle light 90 is operated in its low-beam mode due to increased traffic in recent years. Therefore, the loss of light in a low-beam mode operation has become a significant problem from viewpoints of utilization efficiency of light emitted from the light source 91*a* and long distance visibility of the vehicle light 90.

Further, in the conventional vehicle light 90 comprising an ellipse group reflecting surface 92, it is difficult to form a large diameter of the projection lens 94. Since the projection lens 94 converges light rays incident thereto by a predetermined degree, the illumination angle of the vehicle light 90 tends to be laterally small. Additionally, during operation of the vehicle light 90, the light emitting area of the vehicle light 90 is smaller than that of other types of conventional vehicle lights without the projection lens 94. Accordingly, visibility from a viewpoint of an on-coming vehicle or people is deteriorated in comparison with other types of conventional vehicle lights without the projection lens 94.

SUMMARY OF THE INVENTION

In order to resolve the aforementioned drawbacks and problems in the related art, the present invention provides vehicle lights that can include the following structures. In a first aspect of the present invention, a vehicle light includes a single light source capable of switching a light distribution pattern between low-beam mode and high-beam mode by a movable portion, a first reflecting surface whose longitudinal direction is along an optical axis X of the vehicle light, and having a first focus in the vicinity of the light source, for reflecting light rays from the light source forward, a projection lens, and a shutter for providing a predetermined shape to the light rays from the first reflecting surface on formation of a low-beam mode light distribution pattern by being selectively inserted in the luminous flux from the first reflecting surface to the projection lens. The vehicle light can also include a second reflecting surface of an ellipse group reflecting surface having its first focus approximately on the light source and its second focus at a predetermined position; at least one third reflecting surface having a first focus in a predetermined position and at least one second focus in at least one predetermined position; a fourth reflecting surface having a focus approximately on the second focus of the second reflecting surface for reflecting light rays in a predetermined forward direction. When the third reflecting surface is located in its inserted position relative to the luminous flux from the second reflecting surface to the fourth reflecting surface, the first focus of the at least one third reflecting surface is preferably substantially on the second focus of the second reflecting surface, and the movable portion includes the shutter and the at least one third reflecting surface.

In another aspect of the present invention, the corresponding second focus of the at least one third reflecting surface can be located in the horizontal vicinity of the focus of the first reflecting surface.

In yet another aspect of the present invention, the at least one third reflecting surface and its corresponding second focus can be located at the same side relative to the optical axis of the vehicle light.

In still another aspect of the present invention, the movable portion preferably includes an aperture or a window portion located in an area corresponding to an optical path from the second reflecting surface to the fourth reflecting surface when the at least one third reflecting surface is located in its removed position relative to the luminous flux from the second reflecting surface to the fourth reflecting surface.

In another aspect of the present invention, the vehicle light further include at least one fifth reflecting surface having a focus approximately on the corresponding second focus (or foci) of the at least one third reflecting surface for reflecting light rays forward.

In a further aspect of the present invention, each of the at least one third reflecting surfaces preferably includes at least two third reflecting surface elements, each of the at least two third reflecting surface elements having a first focus at respective predetermined positions in the vicinity of the second focus of the second reflecting surface, and a common second focus.

In yet another aspect of the present invention, the common second focus is approximately on the corresponding focus of the at least one fifth reflecting surface.

In another aspect of the present invention, the movable portion includes a rotational axis, and can be rotated around the rotational axis such that the shutter and the third reflecting surface can be inserted in or removed from their corresponding luminous flux.

In a still further aspect of the present invention, the movable portion can include a solenoid, a return spring, and a stopper.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE PREFERRED EMBODIMENTS

Figure 1:
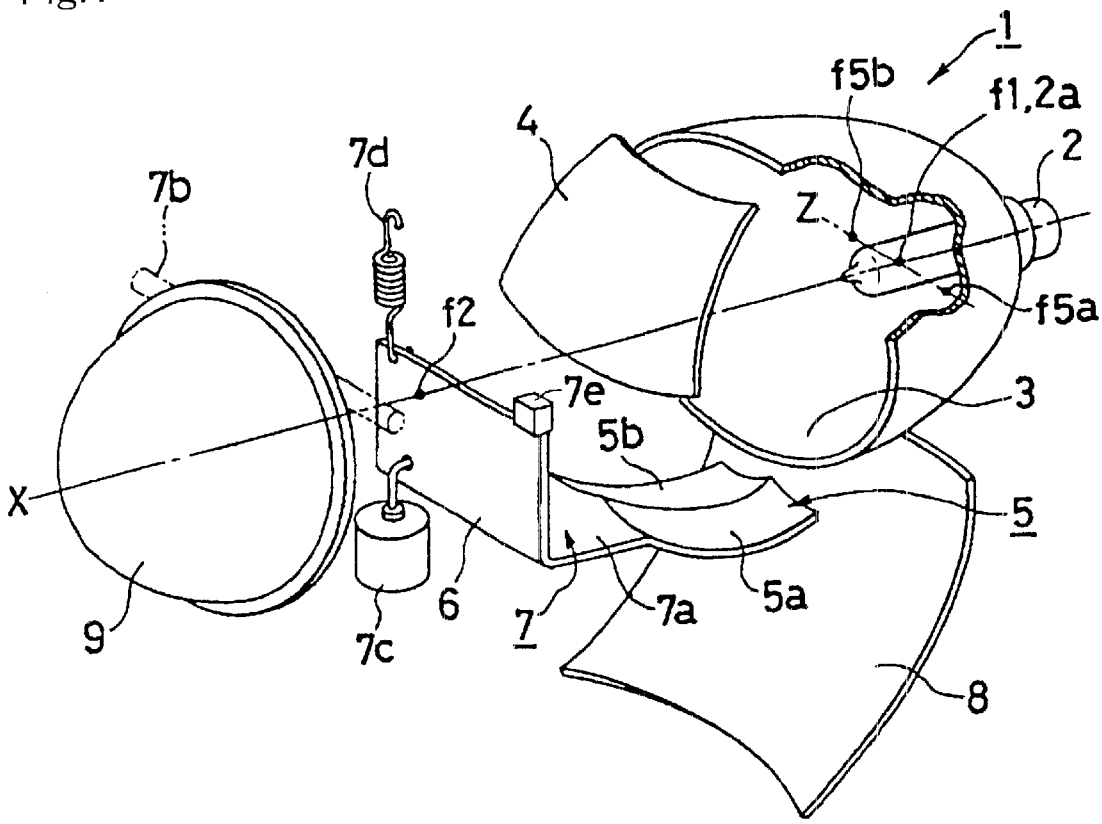
FIG. 1 is a schematic perspective view of a vehicle light according to a preferred embodiment of the present invention.

A detailed description of the present invention will now be given based on embodiments shown in the drawings. Whenever possible, the same reference numbers are used throughout the drawings to refer to the same or like parts.

FIGS. 1–5 show a vehicle light 1 according to a preferred embodiment of the present invention. The vehicle light 1 can include a light bulb 2 having a single light source 2*a* such as a high intensity discharge lamp or an incandescent lamp, a first reflecting surface 3, a second reflecting surface 4, a third reflecting surface 5, a shutter 6, a fourth reflecting surface 8, and a projection lens 9. The shutter 6 and the third reflecting surface 5 can be configured as one unit, to create a movable portion 7.

The first reflecting surface 3 is a concave surface when viewed in a direction facing towards the front of the vehicle light 1 and has a focus f1 approximately on the light source 2*a*. The first reflecting surface 3 is preferably an ellipse group reflecting surface such as a rotated elliptic surface having a first focus f1 in the vicinity of the light source 2*a* and a second focus f2 at a predetermined position approximately on the optical axis X of the vehicle light 1. Throughout the present invention, the ellipse group reflecting surface can be defined as a curved surface having an ellipse or a similar shape as a whole, such as a rotated elliptic surface, a complex elliptic surface, an ellipsoidal surface, an elliptic cylindrical surface, an elliptical free-curved surface, or a combination thereof. If a light source is located on a first focus of the ellipse group reflecting surface, light rays emitted from the light source converge to a second focus of the ellipse group reflecting surface.

Light rays reflected by the first reflecting surface 3 converge in the vicinity of the second focus f2. In the vicinity of the second focus f2, a shutter 6 can be disposed for formation of a low-beam mode light distribution pattern, i.e., a passing-by light distribution pattern.

In the vehicle light 1, a direction of the optical axis X of the vehicle light 1 is substantially the same as the longitudinal axis of the first reflecting surface 3.

The projection lens 9 is preferably a convex lens having a focus in the vicinity of the second focus f2 of the first reflecting surface 3, and an axis substantially the same as the optical axis X.

The second reflecting surface 4 is also preferably an ellipse group reflecting surface having a first focus f1 approximately on the light source 2*a*, a longitudinal axis Y, and a second focus f4 at a predetermined position on the longitudinal axis Y. The longitudinal axis Y is preferably directed the downward in an illumination direction of the vehicle light 1. The illumination direction of the vehicle light 1 is parallel to the optical axis X. The second reflecting surface 4 can be disposed not to intervene the optical path traveling from the first reflecting surface 3 to the vicinity of the focus of the projection lens 9, i.e., the second focus f2 of the first reflecting surface 3. In order to achieve such a disposition, the second reflecting surface 4 is designed by adjusting the eccentricity of an ellipse which forms the second reflecting surface 4 and an angle between the optical axis X of the vehicle light 1 and longitudinal axis Y of the second reflecting surface 4.

The third reflecting surface 5 can include a first element 5*a* located at the left side of the optical axis X, and a second element 5*b* located at the right side of the optical axis X. Throughout the present invention, left and right mean those when viewed in a direction along an illumination direction of the vehicle light according to the preferred embodiments of the present invention.

The left third reflecting surface element 5*a* can include an ellipse group reflecting surface having, in its low-beam mode position, a first focus f5 approximately on the second focus f4 of the second reflecting surface 4, and a second focus f5*a* in a predetermined position at the same side as the left third reflecting surface element 5*a* and located relative to the optical axis X. The second focus f5*a* is located approximately on a horizontal line Z which passes through the light source 2 approximately perpendicular to the optical axis X.

The right third reflecting surface element 5*b* can include an ellipse group reflecting surface having, in its low-beam mode position, a first focus f5 approximately on the second focus f4 of the second reflecting surface 4, and a second focus f5*b* at a predetermined position in the same side as the right third reflecting surface element 5*b* relative to the optical axis X. The second focus f5*b* is located approximately on the horizontal line Z which passes through the light source 2 approximately perpendicular to the optical axis X. The second focus f5*b* of the right third reflecting surface element f5*b* is preferably located in a predetermined position which is symmetrical to the second focus f5*a* of the left third reflecting surface element 5*a* relative to the light source 2.

It is preferable that the first and second third reflecting surface elements 5*a*, 5*b* and their respective second foci f5*a*, f5*b* are located at the same side relative to the optical axis X, because an amount of light loss or unintended refraction caused by incidence of light rays traveling from the third reflecting surface 5 into a light bulb of glass material is decreased. In a case where the first third reflecting surface element 5*a* or the second third reflecting surface element 5*b* is located at a predetermined side of the optical axis X, e.g., left, and its corresponding second focus f5*a*, or f5*b* is located at the other side of the optical axis X, e.g., right, a larger portion of the light bulb is located in the optical paths from the first third reflecting surface element 5*a* and the second third reflecting surface element 5*b* to their respective second foci f5*a*, f5*b* than in the case where the first and second third reflecting surface elements 5*a*, 5*b* and their respective second foci f5*a*, f5*b* are located at the same side relative to the optical axis.

The left third element 5*a* and the right third element 5*b* can be connected to each other so as not to intervene in their respective optical functions.

The third reflecting surface 5 and the shutter can be connected to each other by a connecting portion 7*a* to form a single unit, i.e., a movable portion 7, such that, when the vehicle light 1 is operated in its low-beam mode, the third reflecting surface 5 and the shutter 6 are located in their respective low-beam mode positions. The movable portion 7 can further include a rotational axis 7*b*, a driver 7*c* such as a solenoid, a return spring 7*d*, and a stopper 7*e*. The movable portion 7 can be rotated around the rotational axis 7*b*.

When the driver 7*c* is driven, the movable portion 7 is rotated around the rotational axis 7*b* such that the shutter 6 and the third reflecting surface 5 are moved to their respecting high-beam mode positions. When the driver 7*c* is not operated, the shutter 6 and the third reflecting surface 5 are moved to, and stay in their respecting low-beam mode positions by the pulling force of the return spring 7*d* and by the stopper 7*e* retaining the shutter 6 in its low-beam mode position.

It is possible to design driver 7*c* to operate to move the shutter 6 and the third reflecting surface 5 from their respective high-beam mode positions to low-beam mode positions. However, it is preferable to design driver 7*c* to operate to move the shutter 6 and the third reflecting surface 5 from their respective low-beam mode positions to high-beam mode positions. The vehicle light 1 is operated in its low-beam mode during most of the time of operation. Accordingly, power consumption is reduced if the return spring 7*d* is set to pull the movable portion 7 to its low-beam mode position. Further, in the case where the driver 7*c* malfunctions, the shutter 6 can be returned to and stay in its low-beam mode position by the return spring 7*d* and the stopper 7*e*. Accordingly, upwardly directed light rays are not inadvertently illuminated from the vehicle light 1 if the driver 7*c* malfunctions.

The fourth reflecting surface 8 preferably includes a parabolic group reflecting surface having a focus f8 approximately on the second focus f4 of the second reflecting surface 4, and a longitudinal axis Q substantially parallel to the optical axis X. Throughout the embodiments of the present invention, the parabolic group reflecting surface can be defined as a curved surface having a parabola or similar shape as a whole, such as a rotated parabolic source, a complex parabolic surface, a paraboloidal surface, a parabolic free-curved surface, or a combination thereof. Light rays emitted from a light source located on a focus of the parabolic group reflecting surface are reflected to be parallel to the axis of the parabolic group reflecting surface.

Location of the focus f8 of the fourth reflecting surface 8 can be different from the second focus f4 of the second reflecting surface 4, provided that light rays reflected by the fourth reflecting surface 8 include no upwardly directing light rays relative to their incident positions on the fourth reflecting surface 8. For example, the focus f8 can be located slightly below the second focus f4 of the second reflecting surface 4, i.e., the focus of the projection lens 9. Alternatively, the longitudinal axis direction Q of the fourth reflecting surface 8 can be inclined in a slightly downward direction relative to a line parallel to the optical axis X.

Light rays converged in the vicinity of the second focus f4 of the second reflecting surface 4 can be reflected exclusively by either the third reflecting surface 5 or the fourth reflecting surface 8 in accordance with operation of the movable portion 7. The operation of the movable portion 7 and change of light distribution characteristics accompanied thereby will now be described with reference to FIGS. 2–5.

Figure 2:
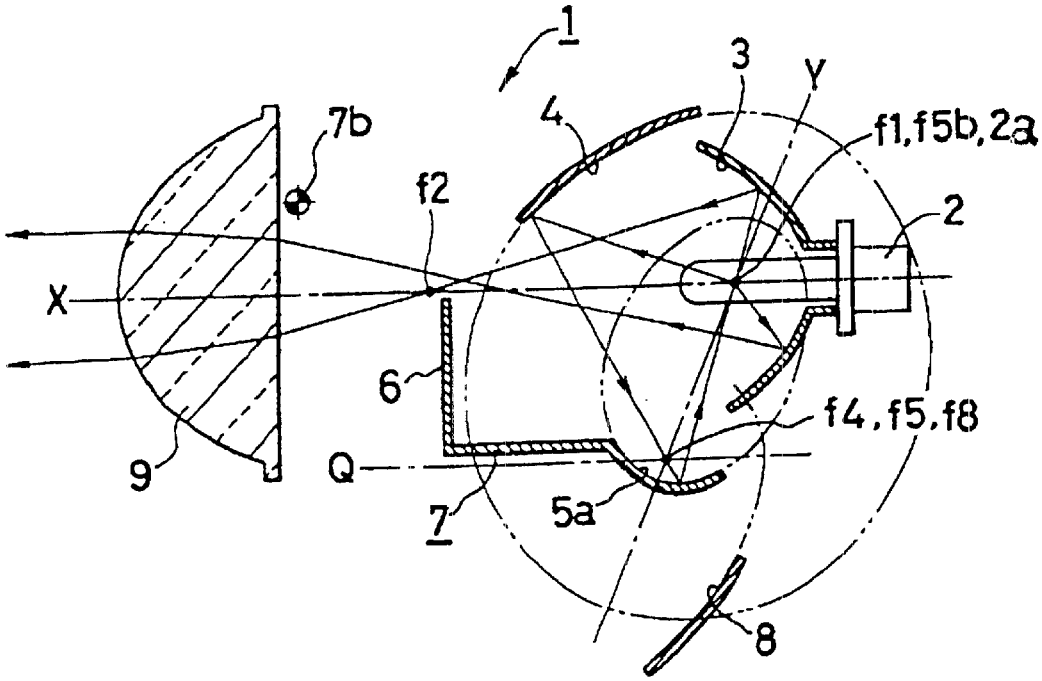
FIG. 2 is a vertical cross-sectional view along an optical axis X of the vehicle light of FIG. 1 in low-beam mode.

FIG. 2 illustrates a cross-sectional view along an optical axis X of the vehicle light 1 in low-beam mode. The movable portion 7 is located in its low-beam mode position. At this time, the shutter 6 is inserted in a predetermined position of the luminous flux traveling from the first reflecting surface 3 to form a cut-off portion of the passing-by light distribution pattern. The shutter 6 is preferably located in the vicinity of the focus f2 of the projection lens 9. Further, the third reflecting surface 5 can be located in a predetermined position such that the first focus f5 of the third reflecting surface 5 is consistent with the second focus f4 of the second reflecting surface 4.

Accordingly, when the third reflecting surface 5 is located in its low-beam mode position, light rays converged approximately on the second focus f4 of the second reflecting surface 4 functions as a light source of the third reflecting surface 5. Light rays converged approximately on the second focus f4 of the second reflecting surface 4 are reflected by the third reflecting surface 5 and further converged in the vicinities of the second focus f5*a* of the left third reflecting surface element 5*a* and the second focus f5*b* of the right third reflecting surface element 5*b*.

Since the second foci f5*a,* f5*b* are located at either side of the light source 2 and substantially horizontal to the light source 2, light rays converged approximately on the respective second foci f5*a,* f5*b* can be reflected by the first reflecting surface 3 in the illumination direction of the vehicle light 1.

The third reflecting surface 5 is preferably located in a front downward position from the first reflecting surface 3. Further, the third reflecting surface 5 can be located below the second focus f4 of the second reflecting surface 4. Therefore, if the second foci f5*a,* f5*b* are located approximately on or above a horizontal line Z passing through the optical axis X, light rays traveling from the third reflecting surface 5 are reflected by a substantially upper half portion of the first reflecting surface 3 to a front downward direction of the first reflecting surface 3. Since no upwardly directing light rays are included in those reflected by the first reflecting surface 3, it is possible to use substantially all light rays reflected by the third reflecting surface 5 for formation of the passing-by light distribution pattern (low beam mode), unless such light rays are blocked by the shutter 6. In order to prevent the light rays which have traveled from the third reflecting surface 5 and further have been reflected by the first reflecting surface 3 from being blocked by the shutter 6, it is preferable that the second foci f5*a,* f5*b* are located approximately on the horizontal line Z passing through the light source 2.

Figure 3:
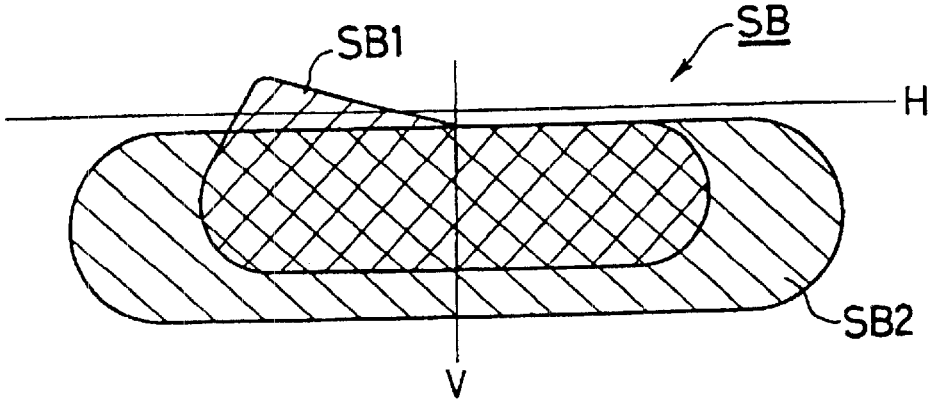
FIG. 3 is a low-beam mode light distribution pattern of the vehicle light of FIG.

FIG. 3 illustrates a low-beam mode light distribution pattern SB when the shutter 6 and the third reflecting surface 5 are located in their respective low-beam mode positions. The low-beam mode light distribution pattern SB includes a first low-beam element SB1 constituted by light rays that have directly come from the light source 2 and further have been reflected by the first reflecting surface 3, and a second low-beam element SB2 constituted by light rays that have been reflected by the third reflecting surface 5 and further by the first reflecting surface 3.

Light rays emitted from the light source 2 directly to the first reflecting surface 3 reach a substantial entirety of the first reflecting surface 3. Accordingly, light rays that have directly come from the light source 2 and have been reflected by the first reflecting surface 3 include light rays traveling in both a front upward direction and a front downward direction relative to their incident positions on the first reflecting surface 3. A predetermined portion of the upwardly directed light rays are cut-off or blocked by the shutter 6, thereby a cut-off portion of the low-beam mode light distribution pattern is formed.

Figure 18:
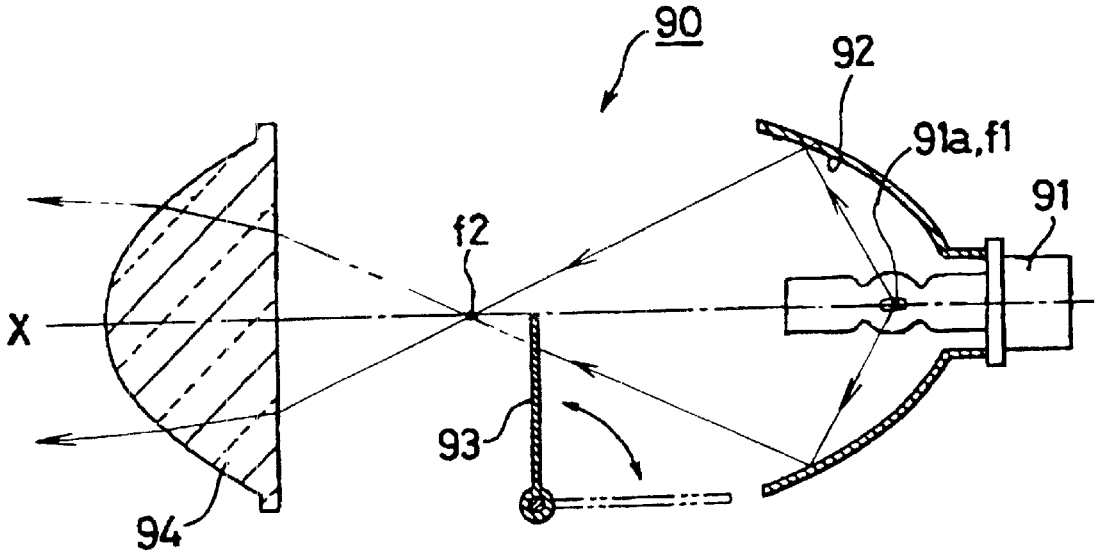
FIG. 18 illustrates a schematic cross-sectional view o f a conventional vehicle light along an optical axis of the conventional vehicle light.

The first low-beam element SB1 of the light distribution pattern SB of the vehicle light 1 can provide substantially the same light amount as that of a conventional low-beam mode light distribution pattern of the conventional vehicle light 90 illustrated in FIG. 18. In addition to the first low-beam element SB1, the vehicle light 1 provides a second low-beam element SB2 constituted by light rays that are reflected by the third reflecting surface 5 and further by the first reflecting surface 3. Accordingly, the vehicle light 1 can provide a brighter low-beam mode light distribution pattern SB than the conventional vehicle light 90.

Further, since the second foci f5*a,* f5*b* of the left and right third reflecting surface elements 5*a,* 5*b* are not in the same location as the first focus f1 of the first reflecting surface 3 but located at either side of the first focus f1 and in outside locations of the first focus f1 in a horizontal direction, the second low-beam element SB2 can illuminate a rather wider area than the first low-beam element SB1. In general, an illuminated area of a projection-type vehicle light that includes a projection lens 9 tends to have a small horizontal angle. However, the vehicle light 1 can provide the low-beam mode light distribution pattern SB with a larger horizontal angle by the second low-beam element SB2.

Figure 4:
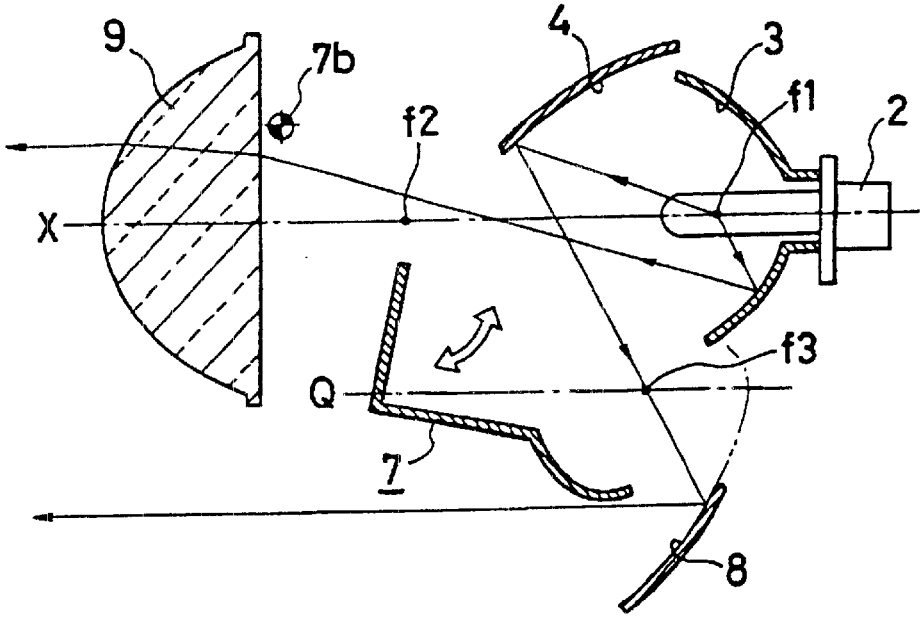
FIG. 4 is a schematic cross-sectional view of the vehicle light of FIG. 1 in high-beam mode.

FIG. 4 illustrates a cross-sectional view along an optical axis X of the vehicle light 1 in high-beam mode. The movable portion 7 is located in its high-beam mode position. At this time, the shutter 6 is located away from an optical path from the first reflecting surface 3 to the focus f2 of the first reflecting surface 3, i.e., the focus of the projection lens 9. Further, the third reflecting surface 5 is also located away from the optical path from the second reflecting surface 4 to the fourth reflecting surface 8. The second focus f4 of the second reflecting surface 4 functions as a light source for the fourth reflecting surface 8. Since the fourth reflecting surface 8 can be a parabolic group reflecting surface having its optical axis approximately parallel to the optical axis X of the vehicle light 1, light rays reflected by the fourth reflecting surface 8 illuminate a direct front of the vehicle light 1.

Figure 5:
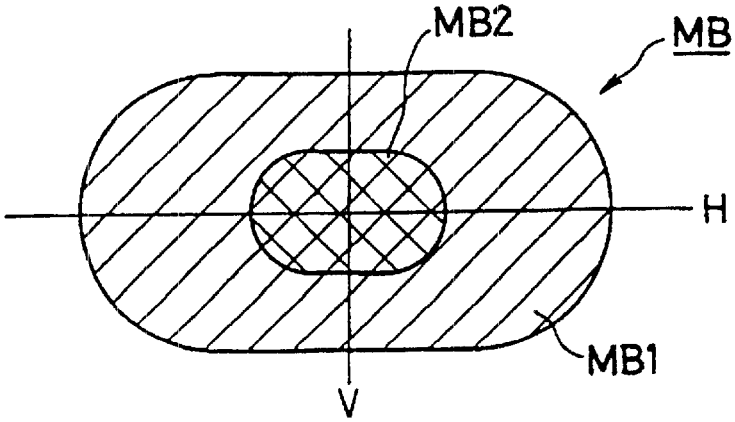
FIG. 5 is a high-beam mode light distribution pattern of the vehicle light of FIG. 1.

FIG. 5 illustrates a high-beam mode light distribution pattern MB of the vehicle light 1. The light distribution pattern MB includes a first high-beam element MB1 constituted by light rays that have directly come from the light source 2*a* and traveled from the light source 2*a* directly to the first reflecting surface 3 and reflected thereby, and a second high-beam element MB2 constituted by light rays that have been reflected by the second reflecting surface 4 and further by the fourth reflecting surface 8. Since the shutter 6 does not cut-off or block any portion of light rays from the first reflecting surface 3, the first high-beam element MB1 includes substantially all upwardly directing light rays from the first reflecting surface 3 that illuminate an upper area of the horizontal axis on the screen. The second high-beam element MB2 preferably illuminates in the vicinity of the center of vertical and horizontal axes on the screen in a concentrated manner for providing sufficient long distance visibility. The radius of curvature of the fourth reflecting surface 8 can be adjusted such that the light rays reflected by the fourth reflecting surface 8 form the second high-beam element MB2 to be like a spot located in the vicinity of the center of vertical and horizontal axes on the screen.

Figure 6:
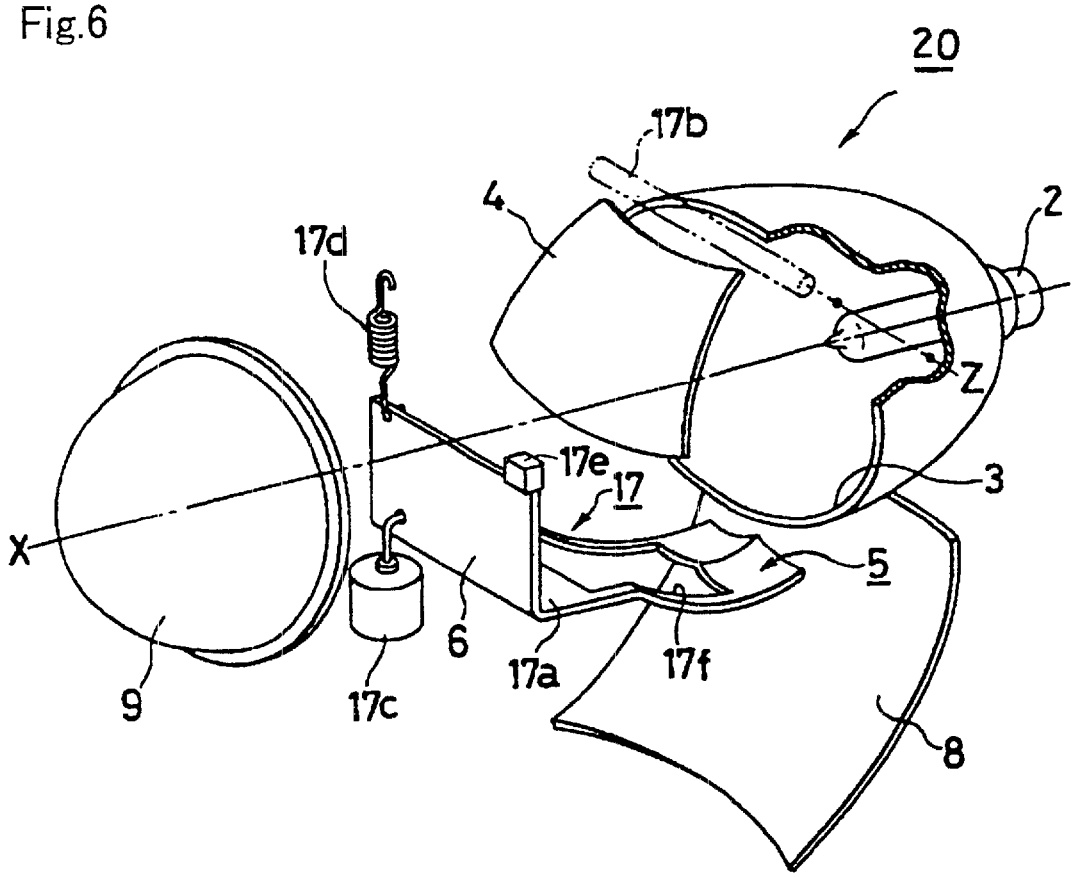
FIG. 6 is a schematic perspective view of a vehicle light according to another preferred embodiment of the present invention.
Figure 7:
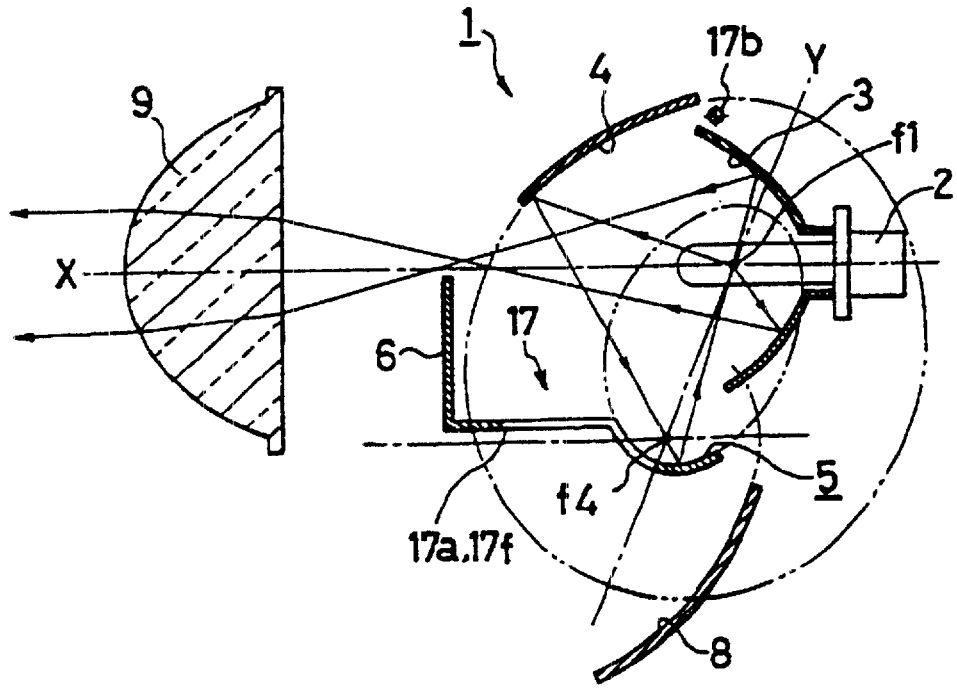
FIG. 7 is a vertical cross-sectional view along an optical axis X of the vehicle light of FIG. 6 in a low-beam mode.
Figure 8:
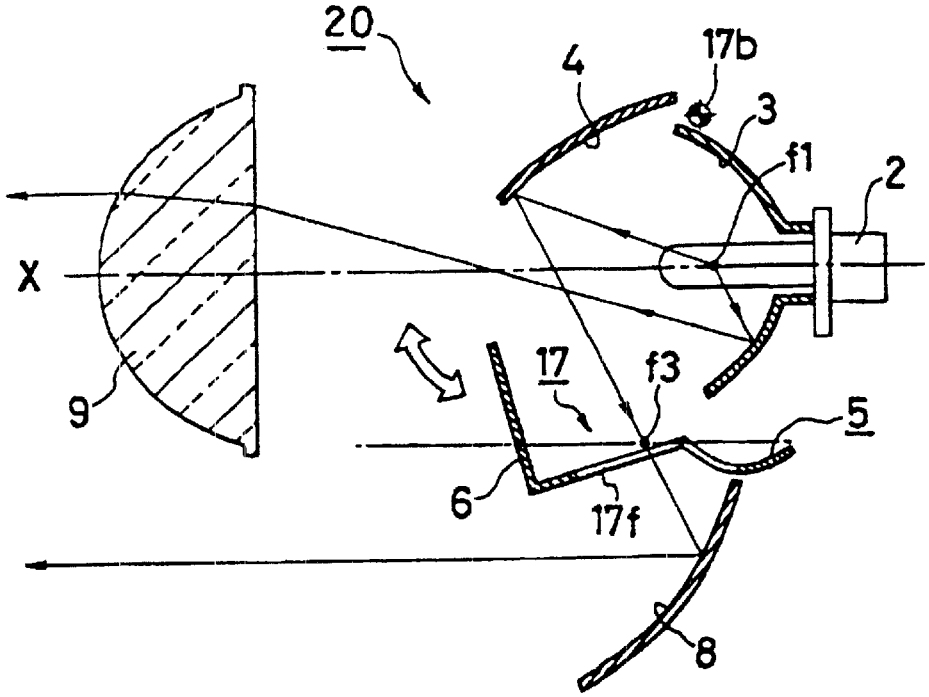
FIG. 8 is a vertical cross-sectional view along an optical axis X of the vehicle light of FIG. 6 in a high-beam mode.

FIGS. 6–8 illustrate a vehicle light 20 according to another preferred embodiment of the present invention. The vehicle light 20 is different from the vehicle light 1 because it includes at least a different movable portion 17. Other elements of the vehicle light 20 are substantially the same as those in the vehicle light 1. Detailed descriptions related to such elements are therefore omitted.

The movable portion 17 can include a third reflecting surface 5, a shutter 6, a connecting portion 17*a,* a driver 17*c,* a return spring 17*d,* and a rotational axis 17*b,* and a stopper 17*e,* that are similar to the vehicle light 1. The movable portion 17 can further include an aperture 17*f* located in a predetermined portion of the connecting portion 17*a* corresponding to the optical path from the second reflecting surface 4 to the fourth reflecting surface 8 when the vehicle light 20 is in high-beam mode. The aperture 17*f* can be replaced by a window portion 17*f.*

In low-beam mode, the optical path of light rays reflected by the second reflecting surface 4 in the vehicle light 20 is substantially the same as that of the vehicle light 1, as shown by FIG. 7. In the high-beam mode of the vehicle light 20, the movable portion 17 is located in its high beam mode position as shown by FIG. 8. At this time, light rays that converge approximately on the second focus f4 of the second reflecting surface 4 pass through the aperture 17*f,* and reach the fourth reflecting surface 8.

In corresponding to a different rotational direction of the rotational axis 17*b* of the vehicle light 20 from that of the rotational axis 7*b* of the vehicle light 1, on mode change of the light distribution pattern between low-beam and high-beam, locations and operation of the rotational axis 17*b,* the driver 17*c,* the return spring 17*d,* and the stopper 17*e* are appropriately adjusted in the vehicle light 20, such that optical effect caused by the rotational axis 17*b,* the driver 17*c,* the return spring 17*d,* and the stopper 17*e* is minimized. For example, the rotational axis 17*b* can be located in the vicinity of the first reflecting surface 3 or the second reflecting surface 4. In these locations, the rotational axis 17*b* is farther away from the projection lens 9 than the structure of the vehicle light 1, such that the projection lens 9 and light rays incident to the projection lens 9 are completely free from any optical effect and deterioration of the aesthetic appearance caused by the rotational axis 7*b,* solenoid 7*c,* return spring 7*d,* and stopper 7*e.*

Figure 9:
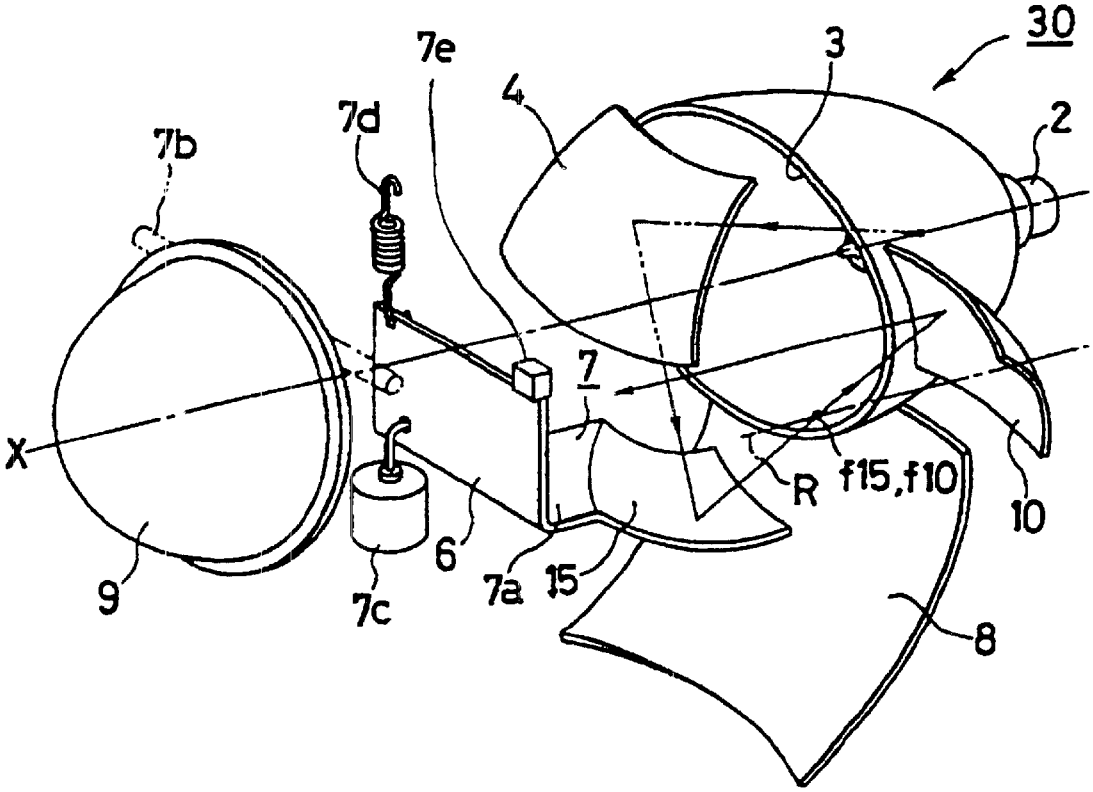
FIG. 9 is a schematic perspective view of a vehicle light according to another preferred embodiment of the present invention.

FIG. 9 illustrates a vehicle light 30 according to another preferred embodiment of the present invention. In the vehicle lights 1 and 20, light rays reflected by the third reflecting surface 5 are incident to the first reflecting surface 3. Since the light source 2 is located approximately on the first focus f1 of the first reflecting surface 3, second foci f5*a,* f5*b* of the left and right third reflecting surface elements 5*a,* 5*b* cannot be located in the same position as the first focus f1 of the first reflecting surface 3. Since the second foci f5*a,* f5*b* are not located in the focus f1 of the first reflecting surface 3, light rays that have been focused approximately on the respective second foci f5*a*, f5*b* then being reflected by the first reflecting surface 3 do not sufficiently converge in a predetermined area, and a portion of such light rays illuminate outside of a predetermined area. As a result, a portion of light rays focused in the vicinity of the second foci f5*a,* f5*b* are not used for the formation of the low-beam mode light distribution pattern, although an amount of such loss of light rays is of an acceptable level.

Then, the vehicle light 30 can include a third reflecting surface 15 of an ellipse group reflecting surface having a first focus approximately on the second focus f4 of the second reflecting surface 4 and a second focus f15 in a predetermined position, and a fifth reflecting surface 10 of a parabolic group reflecting surface located at a predetermined one side of the first reflecting surface 3, e.g., left in FIG. 9, having a focus f10 approximately on the second focus f15 of the third reflecting surface f15. An optical axis R of the fifth reflecting surface 10 can be substantially parallel to, in a slightly downward direction, or inclined slightly inward in a horizontal view relative to the optical axis X, i.e., longitudinal axis of the first reflecting surface 3, depending on a predetermined traveling direction of light rays reflected by the fifth reflecting surface 10.

The fifth reflecting surface 10 can be formed as a continuous smooth surface connected from the first reflecting surface 3 to form a single unit with the first reflecting surface 3. The fifth reflecting surface 10 can be located at the right side of the first reflecting surface 3. In such a case, the second focus f15 of the third reflecting surface 15 is also located at the right side relative to the optical axis X. Alternatively, the fifth reflecting surface 10 can be located at either side of the optical axis X. In such a case, the third reflecting surface 15 may include at least two third reflecting surface elements having their common first focus approximately on the second focus f4 of the second reflecting surface 4 and their respective second foci f15, each second focus f15 functions as a focus of a corresponding fifth reflecting surface element 10.

Since the focus f10 of the fifth reflecting surface 10 and the second focus f15 of the third reflecting surface 15 can be located substantially at the same position, regarding light rays focused approximately on the second focus f15 of the third reflecting surface 15, it is possible to precisely adjust the traveling direction of each light ray reflected by the fifth reflecting surface 10 in a predetermined direction.

Although not shown, a front lens having prismatic cuts on its inner surface can be disposed in front of the fifth reflecting surface 10 for directing light rays from the fifth reflecting surface 10 in respective predetermined directions.

The vehicle light 30 has a larger light-emitting area than the vehicle lights 1, 20, and 90 because of the fifth reflecting surface 10. Accordingly, visibility of the vehicle light 30 from a viewpoint of a driver of a vehicle running on an on-coming lane is improved.

Regarding modification of the vehicle light 20, the fifth reflecting surface 10 can be disposed in the vehicle light 20 at a predetermined side of the optical axis X of the vehicle light 20. In such a case, the third reflecting surface 5 may consist of a single low-beam element 5*a,* or 5*b,* having a first focus approximately on the second focus f4 of the second reflecting surface 4 and a second focus f5*a* or f5*b* approximately on a focus of the fifth reflecting surface 10. Regarding modification of the vehicle lights 10 and 20, the third reflecting surface 5 may include at least two low-beam elements 5*a,* 5*b* having a common first focus f5 approximately on the second focus f4 of the second reflecting surface 4 and second foci f5*a,* f5*b* in different positions. A second focus f5*a* may be located at a predetermined side of the optical axis X, on which side the single fifth reflecting surface 10 is not located. The other second focus f5*b* may be located at the other side of the optical axis X, being a focus of the fifth reflecting surface 10.

FIGS. 10–17 illustrate a vehicle light 40 and its light distribution patterns according to another preferred embodiment of the present invention. The vehicle light 40 can have a similar basic structure as compared to the vehicle light 30. Detailed descriptions regarding the same elements as in the vehicle light 30 are now therefore omitted.

The vehicle light 40 can be different from the vehicle light 30 at least in the structure of the third reflecting surface 5. In corresponding to the different structure of the third reflecting surface 5, the number of fifth reflecting surfaces 10, and the structure of the movable portion 7 are modified.

Figure 10:
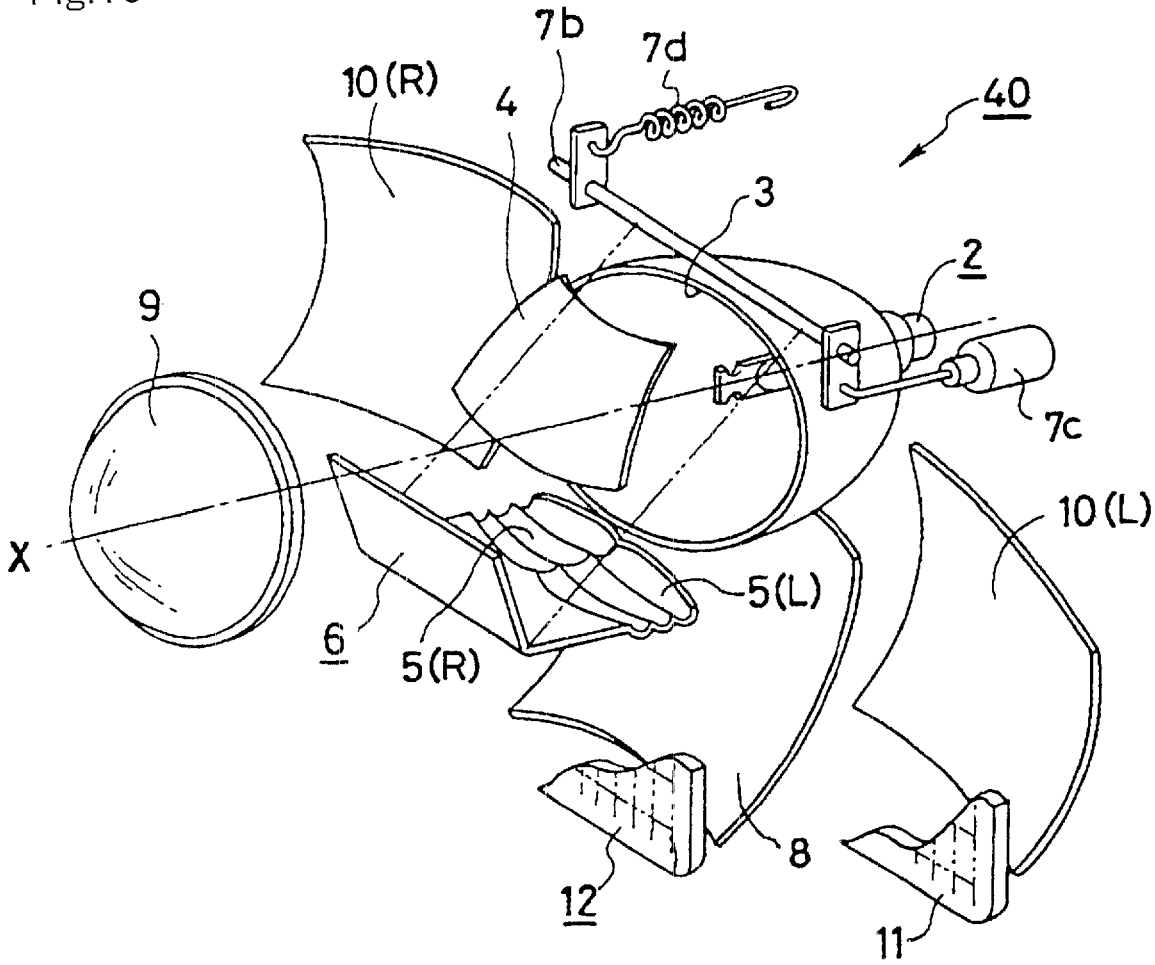
FIG. 10 is a schematic perspective view of a vehicle light according to another preferred embodiment of the present invention.

The third reflecting surface 5 can be divided into a predetermined number of ellipse group reflecting surface elements. In FIG. 10, the third reflecting surface 5 comprises a left third reflecting surface element 5(L) and a right third reflecting surface element 5(R) divided along the optical axis X of the vehicle light 40. Each of the left and right third reflecting surface elements 5(L) and 5(R) can be further divided into three elements. In FIG. 10, the number of ellipse group reflecting surface elements that collectively constitute the third reflecting surface 5 is six. However, the number of elements that collectively constitute the third reflecting surface 5 is not limited to six, and is determined in accordance with design requirements. For example, only one of the two third reflecting surface elements 5(L) and 5(R) can be included in the third reflecting surface 5. In such a case, only one of the two fifth reflecting surfaces 10(L) and 10 (R) can be included in the vehicle light 40. Alternatively, the left and right third reflecting surface elements 5(L) or 5(R) can be divided into a predetermined number of elements other than three. Detailed descriptions of a preferred embodiment of the present invention are made referring to FIGS. 10–17 as an example case where the vehicle light 40 includes the third reflecting surface 5 including the left third reflecting surface element 5(L) and the right third reflecting surface element 5(R), each including three ellipse group reflecting surface elements, and two fifth reflecting surfaces 10(L), 10 (R) located at either side of the first reflecting surface 3.

It is preferable that the rotational axis 7*b,* the solenoid 7*c,* and the return spring 7*d* are located in their respective positions so as not to intervene in any optical path in the vehicle light 40. In the vehicle light 40, since the fifth reflecting surfaces 10(L), 10(R) are preferably located at either side of the first reflecting surface 3, the rotational axis 7*b,* the solenoid 7*c,* the return spring 7*d,* and the stopper 7*e* are preferably located in their respective predetermined positions in the vicinity above the first reflecting surface 3, as shown by FIG.

Figure 13:
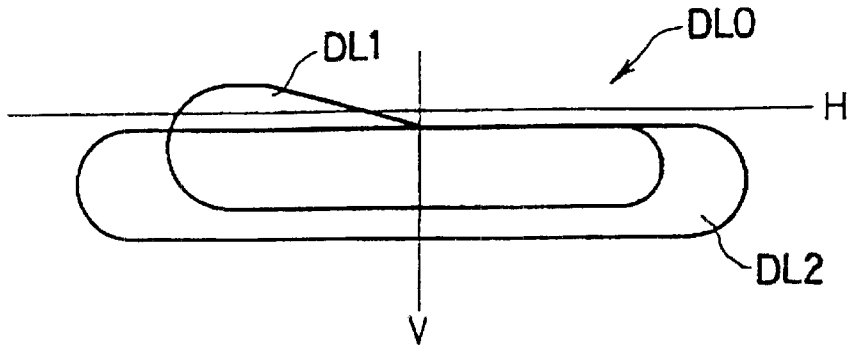
FIG. 13 is a low-beam mode light distribution pattern of the vehicle light of FIG. 10.
Figure 16:
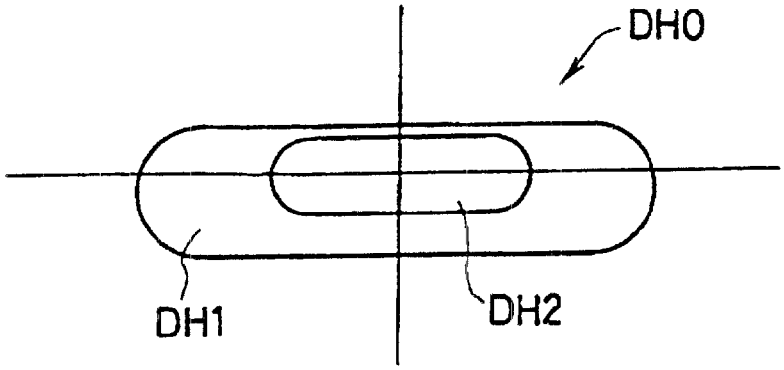
FIG. 16 is a high-beam mode light distribution pattern of the vehicle light of FIG. 10.

The vehicle light 40 is also different from the vehicle light 30 in illumination directions of the fourth reflecting surface 8 and the fifth reflecting surface 10. In the vehicle light 40, the fourth reflecting surface 8 can include a parabolic group reflecting surface having a focus approximately on the second focus f4 of the second reflecting surface 4, and illuminates a rather wide predetermined front area DL2 in a low-beam mode light distribution pattern as shown in FIG. 13. Each of the fifth reflecting surfaces 10(L) and 10 (R) in the vehicle light 40 is a parabolic group reflecting surface having a focus approximately on the second focus f5*a* or f5*b* of the third reflecting surface 5 located at the same side as the fifth reflecting surface 10(L) or 10(R) relative to the optical axis X, and illuminates a predetermined front area DH2 in the vicinity of the center of the vertical and horizontal axes on the screen in a high-beam mode light distribution pattern as shown in FIG. 16. Radii of curvatures of the fourth reflecting surface 8 and the fifth reflecting surface 10(L) and 10(R) are respectively adjusted to satisfy such requirements of the illumination directions.

In FIG. 10, the vehicle light 40 can include a front lens 12 in front of the fourth reflecting surface 8. The front lens 12 is not necessarily included in the vehicle light 40. The front lens 12 facilitates obtaining predetermined light distribution characteristics of light rays illuminated from the fourth reflecting surface 8.

Figure 11:
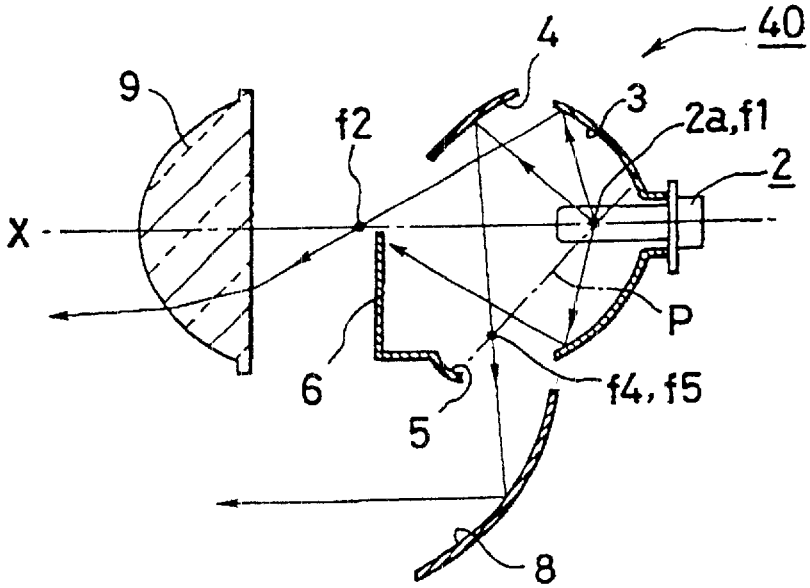
FIG. 11 is a vertical cross sectional view along an optical axis X of the vehicle light of FIG. 10 in a low-beam mode.
Figure 12:
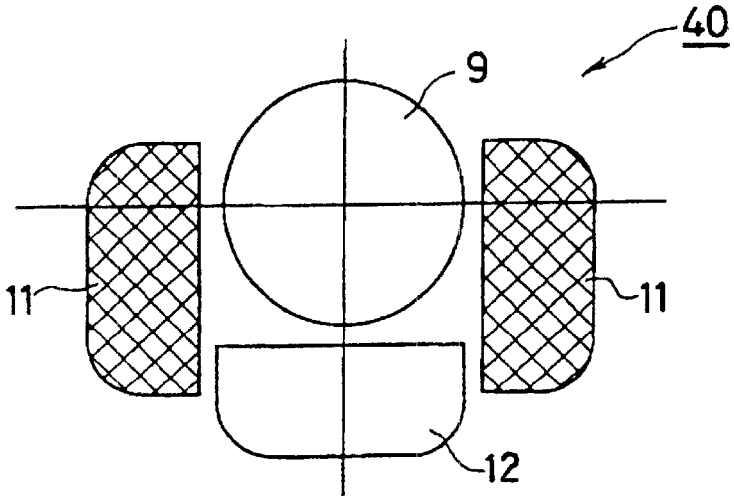
FIG. 12 is a front view of the vehicle light of FIG. 10 in a low-beam mode.

When the vehicle light 40 is in low-beam mode, the movable portion 7 that can include the shutter 6, and the third reflecting surface 5 is located such that the shutter 6 is inserted in the optical path from the first reflecting surface 3 to the projection lens 9 and such that the third reflecting surface 5 is located away from the optical path from the second reflecting surface 4 to the fourth reflecting surface 8, as shown by FIG. 11. The shutter 6 can be located in the vicinity of the second focus f2 of the first reflecting surface 3. At this time, as shown by FIG. 12, light is illuminated from the projection lens 9 and from a front lens 12 located in front of the fourth reflecting surface 8. FIG. 13 illustrates a low-beam mode light distribution pattern DL0 of the vehicle light 40. The light distribution pattern DL0 includes a first low-beam pattern element DL1 constituted by light rays passed through the projection lens 9, and a second low-beam pattern element DL2 constituted by light rays passed through the front lens 12. The first low-beam pattern element DL1 is formed by light rays that are emitted from the light source 2*a* directly forward, and those emitted from the light source 2*a* directly to the first reflecting surface 3 and reflected thereby. The second low-beam pattern element DL2 is formed by light rays that are reflected by the second reflecting surface 4 and the fourth reflecting surface 8.

Figure 14:
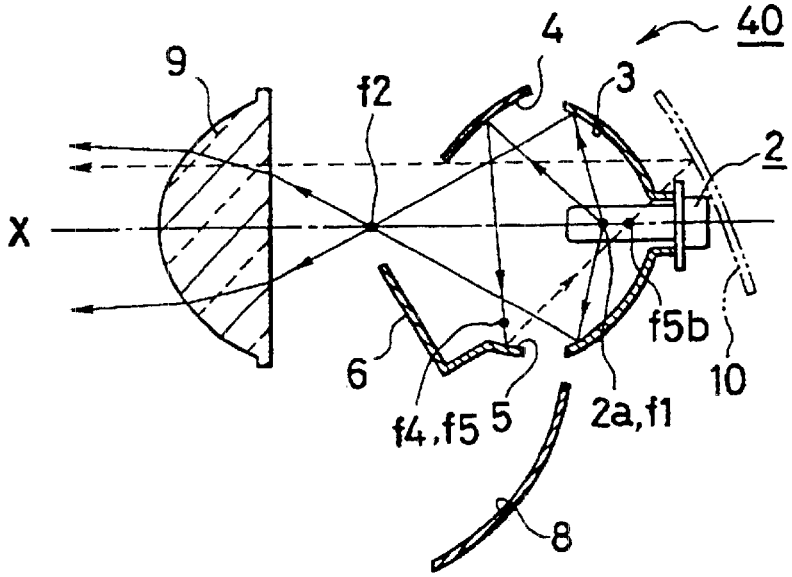
FIG. 14 is a vertical cross-sectional view along an optical axis X of the vehicle light of FIG. 10 in a high-beam mode.
Figure 15:
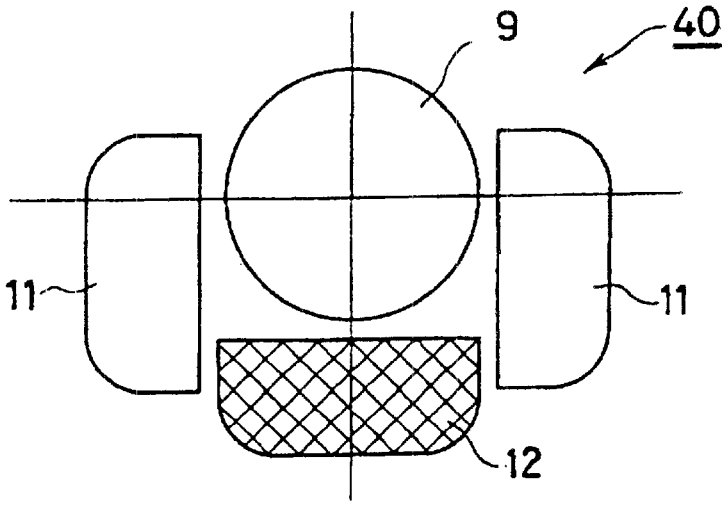
FIG. 15 is a front view of the vehicle light of FIG. 10 in a low-beam mode.

When the vehicle light 40 is in high-beam mode, the movable portion 7 that can include the shutter 6 and the third reflecting surface 5 is located such that the shutter 6 is located away from the optical path from the first reflecting surface 3 to the projection lens 9 and such that the third reflecting surface 5 is inserted in the optical path from the second reflecting surface 4 to the fourth reflecting surface 8. At this time, as shown by FIG. 14, the shutter 6 is located away from the second focus f2 of the first reflecting surface 3. In addition, the first focus f5 of the third reflecting surface 5 is located approximately on the second focus f4 of the second reflecting surface 4, and the second foci f5*a,* f5*b* of the third reflecting surface 5 functions as a light source of the fifth reflecting surface 10(L), 10(R). At this time, as shown by FIG. 15, light is illuminated from the projection lens 9 and a front lens 11 located in front of the fifth reflecting surface 10(L), 10(R).

FIG. 16 illustrates a high-beam mode light distribution pattern DH0 of the vehicle light 40. The light distribution pattern DH0 includes a first high-beam pattern element DH1 constituted by light rays passed through the projection lens 9, and a second high-beam pattern element DH2 constituted by light rays passed through the front lens 11. The first high-beam pattern element DH1 is formed by light rays that are emitted from the light source 2*a* to a direct front and those emitted from the light source 2*a* directly to the first reflecting surface 3 and reflected thereby. The second low-beam pattern element DH2 is formed by light rays that are reflected by the second reflecting surface 4, the third reflecting surface 5, and the fifth reflecting surface 10.

The vehicle light 40 can illuminate a further increased light amount by the structure of the third reflecting surface 5, in comparison with the vehicle light 30 that preferably has two fifth reflecting surfaces 10 at either side of the first reflecting surface 3.

As a modification of the vehicle light 40, the fourth reflecting surface 8 and the fifth reflecting surface 10(L), 10(R) can be designed similarly to those in the vehicle light 30, regarding illumination directions and operation of the fourth reflecting surface 8 and the fifth reflecting surface 10(L), 10(R). In other words, the movable portion 7 that includes the third reflecting surface 5, the fourth reflecting surface 8, and the fifth reflecting surface 10 can be designed such that in low-beam mode the at least one fifth reflecting surface 10(L), 10(R) reflects light rays incident thereon to form the low-beam pattern element DL2, while in high-beam mode the fourth reflecting surface 8 reflects light rays incident thereon to form the high-beam pattern element DH2.

In the vehicle lights 1, 20, 30, and 40, it is difficult to utilize a relatively large area for the third reflecting surface 5. The third reflecting surface 5 is movable. It is not acceptable that the third reflecting surface 5 intervenes in the optical path from the first reflecting surface 3 to the vicinity of its second focus f2. In the vehicle light 1, 20, 30, it is not acceptable that the third reflecting surface 5 in its high beam position intervenes in the optical path from the second reflecting surface 4 to the fourth reflecting surface 8. In the vehicle light 40, it is not acceptable that the third reflecting surface 5 in its low-beam mode position intervenes in the optical path from the second reflecting surface 4 to the fourth reflecting surface 8. Therefore, the third reflecting surface 5 should have a relatively small size, e.g., a minimum size in which the image of light source 2*a* is formed.

On the other hand, the light source 2*a* has a predetermined area corresponding to a filament or a discharge arc. Therefore, the image of light rays that converge approximately on the second focus f4 of the second reflecting surface 4 also has its predetermined area which is not sufficiently relatively small in comparison with the allowable size of the third reflecting surface 5.

Then, in order to further increase an entire light amount illuminated from the vehicle light 40 in comparison with the vehicle light 30 that preferably has two fifth reflecting surfaces 10, the vehicle light 40 preferably includes a third reflecting surface 5 having a different structure from that of the vehicle light 30.

Figure 17:
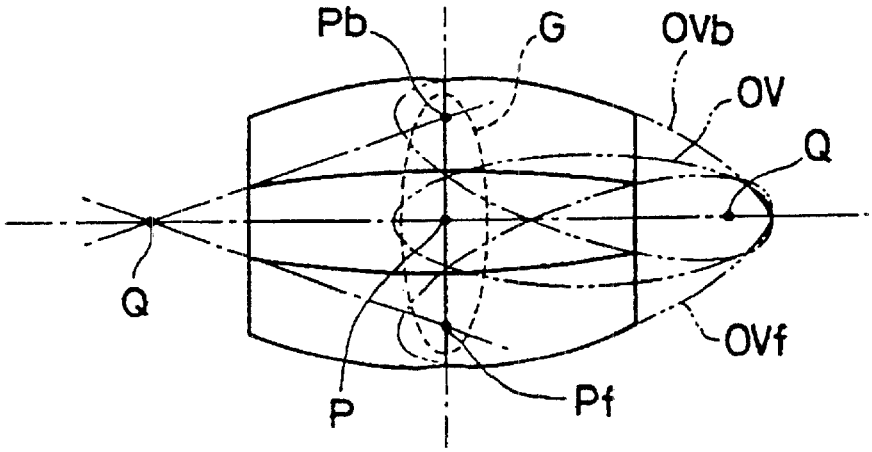
FIG. 17 illustrates part of the vehicle light of FIG. 10.

FIG. 17 schematically illustrates a part of the third reflecting surface 5 of the vehicle light 40 as shown in FIG. 10. Light rays that converge approximately on the second focus f4 of the second reflecting surface 4 forms image G of light source 2*a* in the vicinity of the second focus f4. The image G in FIG. 17 illustrates a case where a longitudinal direction of the light source 2*a* is located along the optical axis X of the vehicle light 40. Since the longitudinal direction of the light source 2*a* is in a front-back direction and the second reflecting surface 4 is located in an upper front area of the light source 2*a,* image G of the light source 2*a* that converges approximately on the second focus f4 of the second reflecting surface 4 has its longitudinal direction in a front-back direction. A center point P of the image G corresponds to the first focus f5 of the third reflecting surfaces 5(L), 5(R) in a case that each of the at least one third reflecting surfaces 5(L), or 5(R) is configured as a single smooth surface of an ellipse group reflecting surface. Points Q located at either side of the center point P correspond to the second foci f5*a,* f5*b* of the left and right third reflecting surface elements 5(L), 5(R), i.e., the respective foci f10 of the fifth reflecting surfaces 10(L), 10(R). Since the left third reflecting surface element 5(L) and the right third reflecting surface element 5(R) are symmetrical in the vehicle light 40 in FIG. 10, the following descriptions are directed mainly to the left third reflecting surface element 5(L). The left third reflecting surface element 5(L) can include a first reflecting portion which is a portion of a first substantial ellipse OV, a second reflecting portion which is a portion of a second substantial ellipse OVf, and a third reflecting portion which is a portion of a third substantial ellipse OVb. The first substantial ellipse OV has a first focus P and a second focus Q. The second substantial ellipse OVf has a first focus Pf located at a predetermined distance in front of the center point P, and a second focus Q. The third substantial ellipse OVb has a first focus Pb located at a predetermined distance in the back of the center point P, and a second focus Q. The second foci Q of the first through third substantial ellipses OV, OVf, OVb are preferably common. If the entirety of the left third reflecting surface element 5(L) is formed as a portion of a single substantial ellipse having a first focus on the center point P and a second focus on a point Q, light rays converged in an area located away from the center point P, e.g., in the vicinities of the respective first foci Pf, Pb, are not sufficiently captured by the first third reflecting surface element 5(L). Then, in the vehicle light 40, the first third reflecting surface element 5(L) can be divided into a predetermined number of ellipse group reflecting surface portions having a common second focus Q and respective first foci P, Pb, Pf. The number of ellipse group reflecting surface portions which collectively constitute the left third reflecting surface element 5(L) and their respective first foci are not limited to three, but can be any other appropriate number, e.g., two, depending on design requirements.

Regarding sizes of the respective substantial ellipses OV, OVf, OVb, eccentricity of each of the substantial ellipses OV, OVf, Ovb is adjusted such that adjacent substantial ellipses (OV, OVf), (OV, OVb) overlap each other such that most of the image G of light source 2*a* is covered by at least any one of the substantial ellipses Ov, OVf, OVb. It is preferable as shown in FIG. 17 that the adjacent substantial ellipses (OV, OVf), (OV, OVb) intersect on a line which connects the first foci P, Pf, and Pb. Since no gap exists between the adjacent substantial ellipses (OV, OVf), (OV, OVb) in the region of the left third reflecting surface element 5(L), and the right third reflecting surface element 5(R) is configured to be symmetrical to the left third reflecting surface element 5(R), an entirety of the image G of light rays in FIG. 17 is covered by at least any one of the six substantial ellipses including OV, OVf, Ovb that collectively constitute the left and right third reflecting surface elements 5(L), 5(R).

Accordingly, light rays that converge approximately on the second focus f4 of the second reflecting surface 4 are captured efficiently by the left and right third reflecting surface elements 5(L), 5(R), each element 5(L), 5(R) including the first through three reflecting portions.

A line connecting the first foci P, Pf, Ps is not necessarily along the optical axis X. For example, in a case where a single fifth reflecting surface 10(L) or 10(R) is included in the vehicle light 40 at one side of the first reflecting surface 3, the line connecting the first foci P, Pf, Ps can be slightly inclined, relative to the front-back direction parallel to the optical axis X, toward the side in which the single fifth reflecting surface 10 is located, provided that a significant portion of the image G of light source 2*a* converged in the vicinity of the second focus f4 of the second reflecting surface 4 is covered by any one of the substantial ellipses Ov, Ovf, or Ovb that collectively constitute the left or right third reflecting surface 5*a* or 5*b* having a common second focus f5*a* or f5*b* on the focus f10 of the single fifth reflecting surface 10(L) or 10(R). It is preferable that adjacent substantial ellipses (OV, OVf), (OV, OVb) intersect each other on the line which connects the first foci P, Pf, and Pb. In another example, in a case where the longitudinal direction of the light source 2*a* is substantially perpendicular to the optical axis direction X, the image G of light rays that converge in the vicinity of the second focus f4 of the second reflecting surface 4 is located to have its longitudinal direction substantially perpendicular to the optical axis direction X. At this time, the line connecting the first foci P, Pf, and Pb is preferably located in a line that is substantially perpendicular to the optical axis direction X, and the substantial ellipses Ov, Ovf, Ovb are located in a lateral direction having a common second focus Q.

The operational advantages of the present invention will now be described. In a vehicle light including a light source, a first reflecting surface, a projection lens, and a shutter, the vehicle light according to the present invention can further include a second reflecting surface, a third reflecting surface, and a fourth reflecting surface. Additionally, a fifth reflecting surface can be included. The second reflecting surface can reflect light rays that are emitted from the light source in a front upward direction toward its second focus located below the first reflecting surface. The light rays converge approximately on the second focus of the second reflecting surface can be further reflected by the third reflecting surface in one of the beam modes of the light distribution pattern and by the fourth reflecting surface in the other mode of the light distribution pattern. The light rays reflected by the third reflecting surface travel to a second focus of the third reflecting surface. Depending on the location of the second focus of the third reflecting surface, the light rays can be further reflected by either the first reflecting surface or the fifth reflecting surface, then illuminate a predetermined front area of the vehicle light. The fourth reflecting surface can have a focus approximately on the second focus of the second reflecting surface, and the light rays reflected by the fourth reflecting surface illuminate a predetermined front area of the vehicle light. In the above structure, the vehicle light can use light rays that are not used in the conventional vehicle light, i.e., light rays reflected by the second reflecting surface, for the formation of the light distribution patterns. Specifically, a light amount illuminated from the vehicle light can be greatly increased in low-beam mode by the fourth or fifth reflecting surface, in comparison with the conventional vehicle light. Accordingly, a light amount illuminated from the vehicle light is increased. In addition, long distance visibility and visibility of the vehicle light from a viewpoint of an on-coming vehicle or people are greatly improved. Since the third reflecting surface and the fifth reflecting surface are not included in the conventional projection-type vehicle light, the third reflecting surface and the fifth reflecting surface can increase a light emitting area of the vehicle light in comparison with the conventional projection-type vehicle light. Therefore, the third and fifth reflecting surfaces emphasize the improvement of visibility of the vehicle light from a viewpoint of oncoming vehicles or people.

Although the foregoing description is directed to the preferred embodiments of the invention, it is noted that other variations and modifications will be apparent to those skilled in the art, and may be made without departing from the spirit or scope of the invention.

What is claimed is:

1. A vehicle light capable of switching between a low-beam mode and a high-beam mode by moving a movable portion, comprising:

a light source;

a first reflecting surface having a longitudinal direction along an optical axis of the vehicle light, and having a first focus in the vicinity of the light source;

a projection lens;

a shutter selectively insertable in luminous flux located between the first reflecting surface and the projection lens;

a second reflecting surface of an ellipse group reflecting surface having a first focus approximately on the light source and a second focus at a predetermined position;

at least one third reflecting surface having a first focus in a predetermined position and at least one second focus in at least one predetermined position; and a fourth reflecting surface having a focus approximately on the second focus of the second reflecting surface;

wherein when the third reflecting surface is located in an inserted position relative to luminous flux located between the second reflecting surface and the fourth reflecting surface, the first focus of the at least one third reflecting surface is substantially on the second focus of the second reflecting surface; and wherein the movable portion includes the shutter and the at least one third reflecting surface.

2. The vehicle light according to claim 1, wherein the second focus of the at least one third reflecting surface is located in the horizontal vicinity of the first focus of the first reflecting surface.

3. The vehicle light according to claim 1, wherein the at least one third reflecting surface and its second focus are located at the same side relative to the optical axis of the vehicle light.

4. The vehicle light according to claim 2, wherein the at least one third reflecting surface and its second focus are located at the same side relative to the optical axis of the vehicle light.

5. The vehicle light according to claim 1, wherein the movable portion further includes an aperture located in an area corresponding to an optical path from the second reflecting surface to the fourth reflecting surface when the at least one third reflecting surface is located in a removed position relative to the luminous flux from the second reflecting surface to the fourth reflecting surface.

6. The vehicle light according to claim 1, further comprising at least one fifth reflecting surface having a focus approximately on the second focus of the at least one third reflecting surface.

7. The vehicle light according to claim 5, wherein the aperture is a window portion.

8. The vehicle light according to claim 1, wherein each of the at least one third reflecting surfaces includes at least two third reflecting surface elements, each of said at least two third reflecting surface elements having a first focus at a position in the vicinity of the second focus of the second reflecting surface, and a common second focus.

9. The vehicle light according to claim 8, further comprising at least one fifth reflecting surface, wherein the common second focus is approximately on a focus of the at least one fifth reflecting surface.

10. The vehicle light according to claim 8, wherein an adjacent two of the at least two third reflecting surface elements intersect each other on a line connecting the first foci.

11. The vehicle light according to claim 1, wherein the movable portion includes a rotational axis, and can be rotated around the rotational axis such that the shutter and the third reflecting surface can be inserted in or removed from their corresponding luminous flux.

12. The vehicle light according to claim 11, wherein the movable portion includes a solenoid, a return spring, and a stopper.

13. The vehicle light according to claim 12, wherein the solenoid, return spring, and stopper are located in a vicinity above the first reflecting surface.

14. The vehicle light according to claim 1, wherein the light source is a single light source.

15. The vehicle light according to claim 1, wherein when the shutter is inserted into luminous flux located between the first reflecting surface and the projection lens, the shutter provides a shape to light rays reflected from the first reflecting surface forming a low-beam light distribution pattern.

16. A vehicle light, comprising:

a light source;

a first reflecting surface having a longitudinal direction along an optical axis of the vehicle light, and having a first focus in the vicinity of the light source, for reflecting light rays from the light source forward;

a projection lens;

a shutter being selectively insertable in luminous flux located between the first reflecting surface and the projection lens for providing a shape to the light rays reflected from the first reflecting surface to form a low-beam mode light distribution pattern;

a second ellipse group reflecting surface having a first focus approximately on the light source and a second focus at a predetermined position;

at least one third reflecting surface having a first focus in a predetermined position and at least one second focus in at least one predetermined position; and a fourth reflecting surface having a focus approximately on the second focus of the second reflecting surface for reflecting light rays in a forward direction;

wherein the at least one third reflecting surface is movable to an inserted position relative to luminous flux located between the second reflecting surface and the fourth reflecting surface, such that when the at least one third reflecting surface is located at the inserted position, the first focus of the at least one third reflecting surface is substantially on the second focus of the second reflecting surface.

17. The vehicle light according to claim 16, wherein the second focus of the at least one third reflecting surface is located in the horizontal vicinity of the first focus of the first reflecting surface.

18. The vehicle light according to claim 16, wherein the at least one third reflecting surface and its second focus are located at the same side relative to the optical axis of the vehicle light.

19. The vehicle light according to claim 16, wherein each of the at least one third reflecting surfaces includes at least two third reflecting surface elements, each of said at least two third reflecting surface elements having a first focus at a position in the vicinity of the second focus of the second reflecting surface, and a common second focus.

20. The vehicle light according to claim 16, wherein the at least one third reflecting surface and the shutter define a movable portion which includes a rotational axis, and can be rotated around the rotational axis such that the shutter and the third reflecting surface can be inserted in or removed from their corresponding luminous flux.

* * * * *